US012677892B2

(12) United States Patent
Caruso et al.

(10) Patent No.: US 12,677,892 B2
(45) Date of Patent: Jul. 14, 2026

(54) PALM COOLING GLOVE TO ENHANCE HEAT TRANSFER/REMOVAL

(71) Applicant: University of Louisville Research Foundation, Inc., Louisville, KY (US)

(72) Inventors: John Caruso, Louisville, KY (US); Peter Quesada, Louisville, KY (US)

(73) Assignee: University of Louisville Research Foundation, Inc., Louisville, KY (US)

( * ) Notice: Subject to any disclaimer, the term of this patent is extended or adjusted under 35 U.S.C. 154(b) by 590 days.

(21) Appl. No.: 16/596,857

(22) Filed: Oct. 9, 2019

(65) Prior Publication Data

US 2020/0107596 A1 Apr. 9, 2020

Related U.S. Application Data

(60) Provisional application No. 62/743,091, filed on Oct. 9, 2018.

(51) Int. Cl.
*A41D 19/015* (2006.01)
*A41D 19/00* (2006.01)

(52) U.S. Cl.
CPC ... *A41D 19/01541* (2013.01); *A41D 19/0013* (2013.01)

(58) Field of Classification Search
CPC ..... A41D 19/01541; A41D 19/01535; A41D 19/002; A41D 19/0053; A41D 19/0034; A41D 19/0037; A41D 19/01594; A61F 7/10; A61F 7/106; A61F 7/02; A61F 2007/0219; A61F 2007/0247
USPC ..... 2/158, 159, 160, 161.1, 161.2, 161.5, 2/161.6, 161.7; 128/402; 607/111, 96; 126/204
See application file for complete search history.

(56) References Cited

U.S. PATENT DOCUMENTS 786,006 A * 3/1905 Cooper ..... A41D 19/002 2/160
1,970,081 A 8/1934 Eisendrath
(Continued)

OTHER PUBLICATIONS

Caruso et al. Intermittent Palm Cooling's Impact on Resistive Exercise Performance. Int J Sports Med, 36: 814-821 (2015).

*Primary Examiner* — Alissa J Tompkins
(74) *Attorney, Agent, or Firm* — ALGM LLP; Harry J. Guttman

(57) ABSTRACT

Palm cooling gloves and similar articles are disclosed which may be worn during exercise or when exposed to warm ambient temperatures. Unlike other items related to thermal exchange, the disclosed devices provide for intermittent cooling in order to ultimately increase the overall rate and magnitude of conductive heat loss from the human body. According to an example embodiment, gloves are provided with high thermal conductivity for rapid rates of heat transfer when the palm is to be cooled, and low thermal conductivity when the palm is not to be cooled. During non-cooling periods, a cooling agent is temporarily stored within a compartment located on the back (dorsal aspect) of the glove. The compartment is comprised of materials with a low thermal conductivity so that the cooling agent retains more of its cold, which allows it to be used repeatedly when palm cooling is again needed to rid the body of excess heat. With a glove that offers both scenarios, users can engage in intermittent palm cooling and reap the benefits of excess body heat removal/transfer.

12 Claims, 5 Drawing Sheets

(56) References Cited

U.S. PATENT DOCUMENTS

| | | | | |
|---|---|---|---|---|
| 4,984,786 | A * | 1/1991 | Lemke | A63B 21/4001 482/105 |
| 5,187,814 | A * | 2/1993 | Gold | A41B 11/00 2/160 |
| 6,141,801 | A * | 11/2000 | Helenick | A41D 19/01535 2/159 |
| 6,944,884 | B1 | 9/2005 | Sokolowski | |
| 8,641,745 | B2 | 2/2014 | Warner et al. | |
| 9,089,176 | B1 | 7/2015 | Crowder | |
| 10,285,462 | B2 | 5/2019 | Charles | |
| 2004/0083529 | A1* | 5/2004 | Tate | A41D 27/20 2/115 |
| 2004/0244090 | A1 | 12/2004 | Langer | |
| 2007/0106352 | A1* | 5/2007 | Carstens | A61F 7/032 607/112 |
| 2012/0079641 | A1 | 4/2012 | Kirchner | |
| 2015/0096094 | A1* | 4/2015 | Elliott | A63B 69/0084 2/19 |
| 2017/0079350 | A1* | 3/2017 | Hourani | A41D 27/201 |
| 2017/0095017 | A1 | 4/2017 | Mirkarimi | |
| 2017/0128271 | A1* | 5/2017 | Freer | A61F 13/00063 |

* cited by examiner

PALM COOLING GLOVE TO ENHANCE HEAT TRANSFER/REMOVAL

CROSS-REFERENCE TO RELATED APPLICATIONS

This application claims the benefit of U.S. Provisional Patent Application No. 62/743,091, filed Oct. 9, 2018, the complete contents of which are herein incorporated by reference.

FIELD OF THE INVENTION

Embodiments generally relate to articles addressing removal of excess body heat.

BACKGROUND

From 1999-2003, 3,442 deaths in the United States were reportedly due to heat exposure. Hyperthermia resulting from exercise and/or exposure to high ambient temperatures is a precursor to heat-related illness and death. Most heat-related illnesses are preventable. High body temperatures evoke dehydration that in turn impairs cardiovascular, thermal and metabolic function. Due to its dramatic increase in production and the subsequent rise in internal temperatures, body heat sees its concentrations rise due to exercise and within individuals exposed to warm environments. Internal body heat product rates from exercise may see its concentrations rise 100-fold above normal values. Sadly, when most people exercise and/or become exposed to warm ambient temperatures they fail to realize the impact excess body heat has on their health and exercise/work performance. Since hyperthermia is a serious problem faced by millions of people on a daily basis, a reliable countermeasure is needed.

Caruso et al., Intermittent palm cooling's impact on resistive exercise performance. Int J Sports Med; 36: 814-821 (2015) describes induced conductive heat loss by periodically placing the palms of subjects hands into an automated (15° C.) water bath. While such a procedure may be appropriate for a laboratory, it is not a viable solution for working professionals and athletes and furthermore prevents use of the hands while they are being cooled.

Cooling towels rapidly lose their ability to maintain cold temperatures. Thus, they are not useful for prolonged exercise or activities in warm climates for extended periods of time.

Existing products may aid heat transfer/removal, but require that users stop the activity that produces the excess body heat. In addition, previous products do not permit users to hold devices/implements in their hand as palm cooling is performed. Thus, they are impractical for many laborers to use as they work and are detrimental to their job productivity, since they must stop what they are doing to cool their palms.

SUMMARY

The proposed devices include palm cooling gloves, and in some embodiments footwear inserts to be worn against the soles of the feet, for use during exercise or when exposed to warm ambient temperatures. Such items increase conductive heat transfer and removal. Exemplary palm cooling gloves provide for intermittent palm cooling. Such gloves present two alternatives: a high thermal conductivity scenario, and thereby high rates of heat transfer, when the palm is to be cooled; and a low thermal conductivity scenario when the palm is not to be cooled. Intermittent cooling is more efficacious than continuous cooling as well as non-cooling conditions.

Palm-cooling gloves that provide conductive heat transfer have great potential as a countermeasure to hyperthermia. While evaporation is the most common means of excess body heat removal, conductive heat transfer, whereby two objects with different amounts of heat are placed in contact with each other, may considerably enhance thermal exchange and help address the problem of excess body heat.

According to one aspect of embodiments, intermittent palm cooling is used to enhance heat removal, metabolism, and exercise performance. Changes in vascular affinity and temperature produce an oscillating pattern of heat loss through the skin and lead to overall greater rates and magnitudes of heat transfer and removal from the human body as compared to continuous cooling and non-cooling conditions.

Intermittent cooling from an exemplary glove is achieved with a reversible flap that is moveable between a palmar side of the glove and a dorsal side of the glove. In the palmar position the flap holds a cooling agent next to or against a wearer's palm to provide rapid heat transfer from the palm to the cooling agent. An exemplary cooling agent has a thermal conductivity of at least 0.606 W/(m K) and a heat capacity of at least 4.184 Joules. To remove the cold stimulus, the flap is moved from the palmar position to the dorsal position. The flap and cooling agent attached to the flap (e.g., inserted in a pouch of the flap) are insertable into an insulated compartment on the dorsal side of the glove. With its cold temperature preserved by materials which surround it with low thermal conductivity, the cooling agent within the flap maintains a cold temperature. That agent may again be used when restoration of the cooling stimulus is needed. When cooling is to be restored, the compartment on the back of the glove is reopened and the flap along with its cooling agent again rewrapped across the hand's palmar surface to then induce conductive heat transfer and removal from the body.

The flap's terminal end may be removably anchored at the palmar position with e.g. a hook-and-loop fastener (e.g. Velcro®) on the back of the glove located approximately on the back of the second metacarpal. The opening of the compartment on the dorsal side of the glove may also be removably fastened e.g. with hook-and-loop fastener, to retain the flap and cooling agent until a user desires to switch the flap's position.

Embodiments of the present disclosure provide palm cooling gloves which may be worn simultaneously on both hands and which can be worn during exercise or exposure to warm ambient temperatures, proving far more practical to the millions at risk of hyperthermia on a daily basis. The palm-cooling glove of the disclosure may be worn as persons exercise or perform their jobs, thus rates of heat transfer/removal are elevated with no disruption to their work/exercise efforts. The glove is an advancement in thermoregulation technology.

Exemplary palm cooling gloves as disclosed herein uniquely allow intermittent application of the cooling stimulus with minimal disruption of activities to those who wear them to remove their excess body heat. Tactile discrimination and manual dexterity of the hands are subject to, at most, minimal disruption when the gloves are worn. The gloves are easily and rapidly converted from cooling to non-cooling conditions (or vice versa) so that persons can continue to engage in exercise or various activities that necessitate their use. By creating a glove that can be converted from cooling to non-cooling conditions, users can engage in intermittent palm cooling and reap the benefits of excess body heat removal/transfer.

Tests of palm cooling glove efficacy with a human research study include a series of thermal, cardiovascular, metabolic and exercise performance measures that may be examined from workouts of both resistive and aerobic exercise. Caruso et al. (Int J Sports Med; 36: 814-821) (2015), incorporated herein by reference, showed intermittent palm cooling, administered between resistive exercise sets, abated decrements in exercise performance and evoked greater body heat and blood lactate losses versus a non-palm cooling treatment. His more recent intermittent palm cooling research saw subjects wear gloves during rowing ergometer workouts. Results showed intermittent palm cooling improved exercise performance, and produced lower blood lactate and heart rate values, versus a non-palm cooling treatment. Comparisons of manual dexterity both with and without the gloves show great promise.

Excess body heat removal is enhanced at glabrous (hairless) skin sites. Such skin covers anastomoses, which are specialized vessels that expedite excess body heat removal through skin pores found on the palm of the hand. Blood flow through anastomoses, as well as the rate and magnitude of excess body heat that can be removed through the hands, is under the control of vascular adrenergic receptors. Intermittent cooling takes advantage of the varying affinity vascular adrenergic receptors have for the hormone norepinephrine. Variations are related in part to the amount of excess body heat.

According to one aspect of embodiments, intermittent palm cooling is used to enhance heat removal, metabolism, and exercise performance. Intermittent palm cooling expedites body heat transfer, as evidenced by significantly higher palm skin temperatures, as well as lower blood lactate values and mitigated decrements in exercise performance. Increases in conductive heat loss through intermittent palm cooling occur by placing cold objects against glaborous (non-hairy) skin. Such skin covers anastomoses, which are specialized vascular structures that expedite heat loss/transfer. Such skin can accommodate large increases in blood flow and heat transfer.

DETAILED DESCRIPTION

Figure 1A:
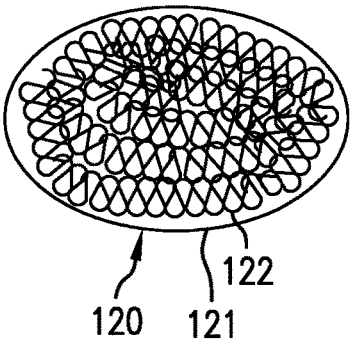
FIG. 1A is a cooling agent.
Figure 1B:
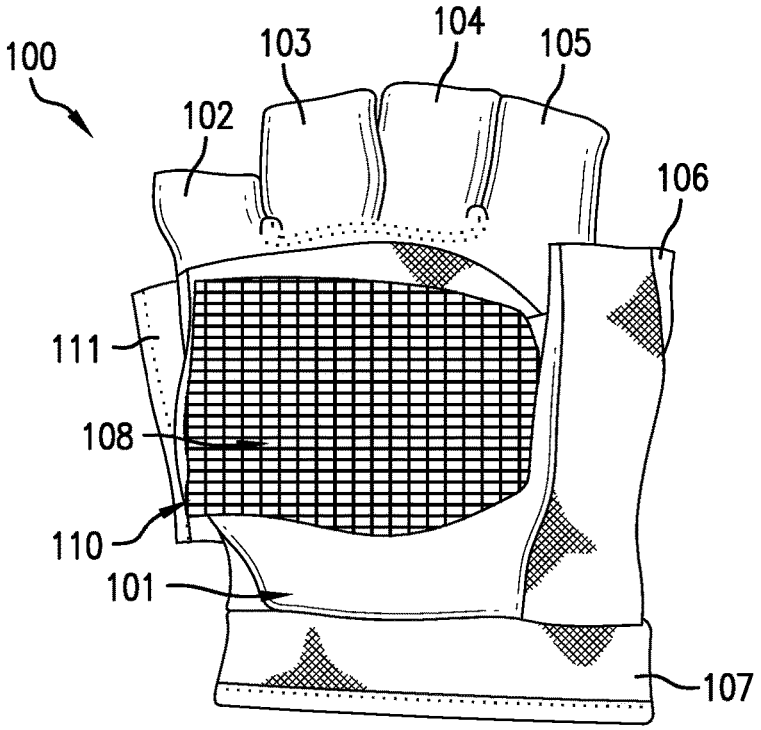
FIG. 1B is a palm cooling glove viewed from a palmar side with a flap of the glove in the palmar position.

FIG. 1B shows a palm cooling glove 100. By "glove" what is meant is an article worn or wearable on a hand. Some embodiments may involve "socks" or like articles which may be configured to be worn on the hand, feet, or either appendage (with cooling on the sole of a foot or else the palm of the hand). The glove 100 includes a covering 101. The covering 101 is sized and shaped to cover part or all of a hand. The covering may serve as a barrier to protect the skin from external conditions, such as sun (UV) exposure, wind, airborne particles such as sand, sharp or abrasive objects or surfaces, among other things. The covering may be one or more of tear resistant, abrasion resistant, UV resistant, and puncture resistant. The covering may be or include a textile, non-woven, leather, or some combination thereof. The covering may be minimalist, e.g., if it is configured for the sole purpose of keeping the glove on the user's hand absent an intention of the user to remove it. The covering may be more extensive, especially if it has a protective element as may be desired for work gloves (e.g., usable for construction) or athletic gloves (e.g., usable for handling bats or balls). The covering may have grip elements (not shown) or the materials selected based on desired grip/friction properties. The covering may have specific parts, e.g., tubes 102, 103, 104, 105, and 106, of material for respective digits of a hand. Each tube may be sized for a specific digit (according to custom or average hand and finger sizes) and arranged with respect to one another according to custom or average relative finger positions. The covering may include a wristband piece 107.

Figure 2:
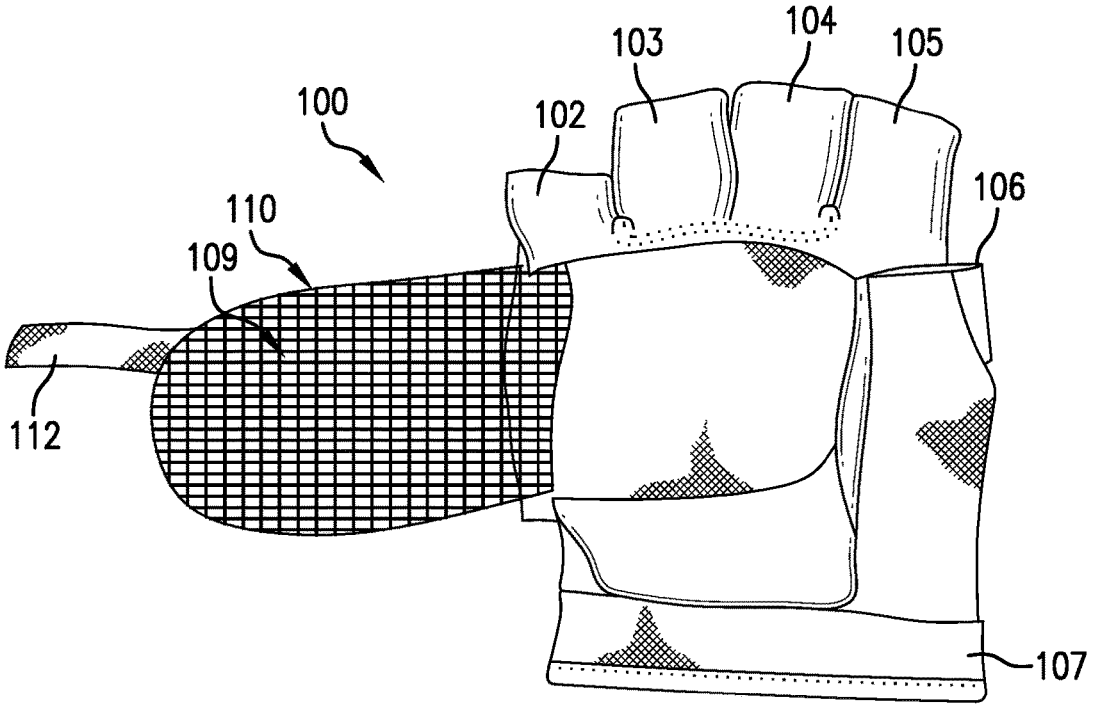
FIG. 2 is the palm cooling glove of FIG. 1B, with a flap thereof rotated away from the palm.
Figure 3:
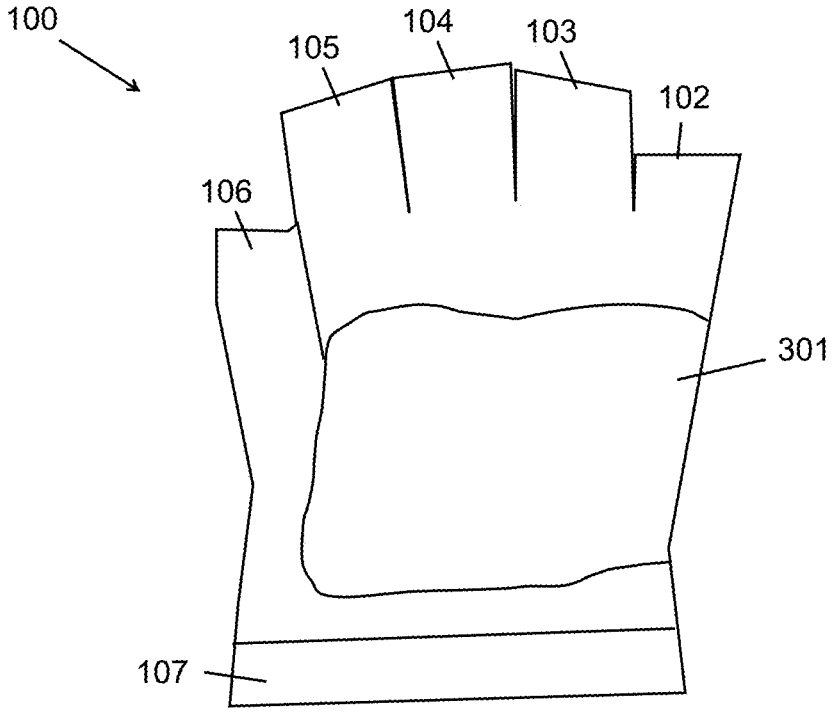
FIG. 3 is the palm cooling glove of FIG. 1B viewed from a dorsal side.

FIGS. 1B and 2 show a palmar side of the glove 100, whereas FIG. 3 shows a dorsal side of the glove 100. The glove 100 comprises a flap 110. The flap 110 is attached (or at least attachable) to the covering 101 and moveable between a plurality of positions with respect to the covering 101, as clear by a comparison of FIG. 1B and FIG. 2. FIG. 1B shows a first side 108 of the flap 110, and FIG. 2 shows a second side 109 of the flap 110. As illustrated, the material of the flap may be a mesh, e.g., a nylon-based mesh. Mesh configurations and nylon both offer minimal resistance to heat transfer. Other materials may also be employed. In some embodiments the flap may include a pouch. For instance, a single or multi-ply material may be used for the flap and configured as a backing to a pouch. Alternatively, the flap itself may be one-in-the-same as a pouch. The flap and pouch have minimal depth and thickness, so persons better maintain manual dexterity and tactile discrimination as the gloves are worn and the palm is cooled. The flap's depth and thickness, without the cooling agent inserted, is not to exceed 0.2 cm. The flap's pouch has a depth and thickness that does not exceed 0.2 cm. By minimizing depth and thickness, conductive heat transfer may best proceed when the flap is placed across the hand's palmar surface. The covering 101 may have thin and highly conductive material or else no material on a palmar surface, with a result that the cooling agent may be in direct contact with the user's palm or else separated by only one or two thin and thermally conductive barriers. Further flap variations are discussed below in connection with FIGS. 6A to 6D.

A cooling agent 120 is attachable to the flap 110. In the illustrated embodiment, attachment entails insertion of the cooling agent 120 into the pouch of the flap 110. The cooling agent 120 is removable, allowing it be placed in a freezer, ice bath, or other artificially cold environment to chill (to remove heat from) the cooling agent 120. In many embodiments it is preferable that the cooling agent have a thermal conductivity of at least 0.606 W/(m K) and a heat capacity of at least 4.184 Joules. As a result, the cooling agent is capable of efficiently and quickly absorbing and then retaining large amounts of heat when brought into contact with a warmer object or surface. A cooling agent 120 may comprise or consist of a liquid-impervious skin or barrier 121 and a liquid or gelatinous coolant 122 contained within the barrier 121. The barrier 121 is flexible and deformable, allowing it to conform comfortably to the shape of a user's palm when in use. The most practical and readily available cooling agents for exemplary gloves are liquid gel packs. A 7.5 cm diameter commercial gel pack easily fits within the flap's pouch. Such gel packs are typically comprised of 89% water and have a latent heat fusion of ~335 $kJ \cdot kg^{-1}$. Once a cold gel pack is inserted into the pouch, the glove has a mass of ~0.4 kg.

The flap 110, and in particular its pouch, as well as the cooling agent 120 are sized to cover a substantial area of a user palm in a state of use. For example, an exemplary pouch and cooling agent diameter is 3.5 inches (8.9 cm). An entire face of the cooling agent 120, save perhaps lines where the mesh interposes between user's skin and barrier 121, may be in contact with the hand's palmar surface when the glove is worn with the flap in the palmar position shown by FIG. 1B. Nylon is exemplary as a material with minimal insulative properties, allowing heat to easily and rapidly transfer from the palm to the cooling agent.

The flap 110 may be wrapped around the hand in either direction, causing the cooling agent 120, if present, to be alternatively positioned adjacent and against the user's palm or else at the back of the hand. The base 111 of the flap may be sewn or otherwise fixed to the glove along the length of the glove, corresponding to the position of the hand's lateral surface of the hypothenar border when the glove is worn on the hand. The flap 110 tapers from its base 110 to its terminal end. A fastener 112 may be provided at the terminal end of the flap 110 to assist in removably fixing the flap 110 in one or more of its available positions (e.g., in the palmar position or else in the dorsal position). A corresponding fastening element (e.g., Velcro®) is provided with which the fastener 112 joins for fixing. For instance, the corresponding fastening element may be arranged on the back of the glove positioned and approximately parallel to the shaft of the second metacarpal's dorsal surface. Appropriate fastener and fastening elements include but are not limited to hook-and-loop (e.g., Velcro®), snaps, or buttons. The flap may be easily repositioned by the user as the gloves are worn, i.e., without the gloves being removed and with next to no interruption of the glove's use, e.g., in lifting, carrying, moving, holding, pulling, pushing, grabbing, etc.

The colder the agent within the pouch and against the palm as the user overheats (whether through physical exertion or exposure to warm ambient temperatures) the higher the temperature gradient and thereby more rapid heat transfer. The cooling agent of the glove possesses high thermal conductivity to permit a high rate and magnitude of thermal exchange. In addition, with the hand much warmer than the cooling agent, a large temperature gradient exists that expedites the transfer of excess body heat. Greater rates and magnitudes of excess body heat removal lessen the risk of hyperthermia, heatstroke and other heat-related ailments.

FIG. 3 shows the back, dorsal aspect of the glove 100. With the flap arranged in the palmar position as depicted in FIG. 1B, the glove 100 provides high thermal conductivity for rapid rates of heat transfer, efficiently cooling the user's palm. By contrast, with the flap arranged in the dorsal position, the glove 100 provides a low thermal conductivity when the palm is not to be cooled. During non-cooling periods, the cooling agent 120 is temporarily stored within a compartment 301 located on the back (dorsal aspect) of the glove 100. The compartment 301 is comprised of materials with a low thermal conductivity so that the cooling agent 120 retains more of its cold (minimizing heat absorption from both the hand and from the environment), allowing it to be used repeatedly when palm cooling is again needed to rid the body of excess heat.

Figure 4:
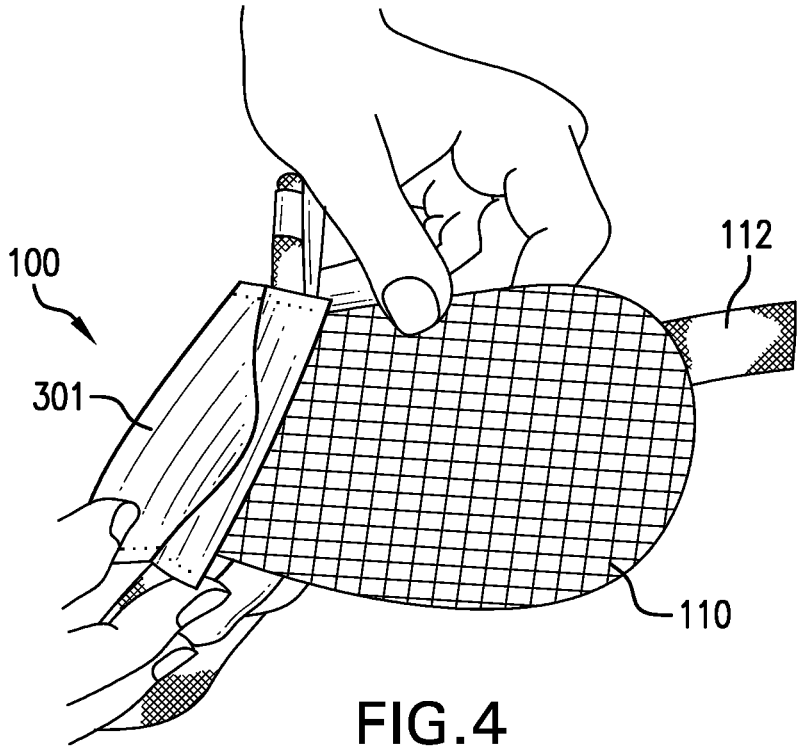
FIG. 4 is a side view showing a dorsal compartment of the glove.

FIG. 4 shows a side view of the glove 100 with the compartment 301 partially opened. The flap 110 may be inserted into the compartment 301 when the palm is to refrain from cooling. The compartment is made of materials that insulate the cooling agent 120 still within the flap 110, thereby extending the life of the agent's cooling properties so it may be repeatedly used for intermittent cold applications. The insulative (low thermal conductivity) materials that comprise the glove's dorsal compartment may include, but are not limited to: polyester, nonwoven polypropylene, woven polypropylene and tarpaulin. The compartment 301 may be sealed, e.g., with a fastener such as hook-and-loop (e.g., Velcro®). When that compartment seal is detached, the compartment is allowed to open. The flap and the cooling agent may then be inserted into the compartment.

Figure 5:
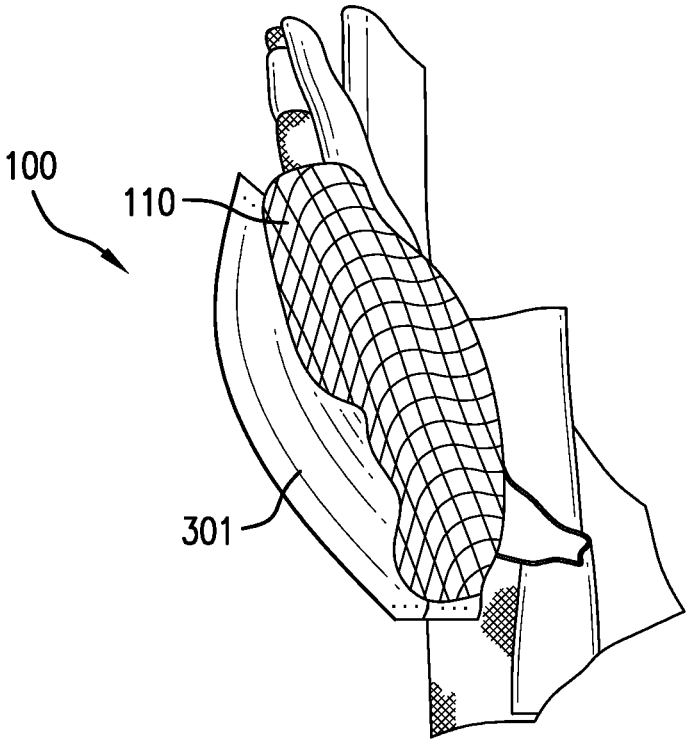
FIG. 5 is a side view of the glove with the flap inserted into the dorsal compartment.

FIG. 5 again shows a side view of the glove 100, but with the flap 110 inserted into the compartment 301. With the flap 110 and cooling agent inserted into the dorsal compartment 301, a scenario of low thermal conductivity is created. The cooling agent retains more of its coldness (absorbs less heat) when the palm is not to be cooled. By retaining more cold, the very same cooling agent may be used again to create sustained intermittent palm cooling over time. The possibility of sustained intermittent cooling is ideal for persons exposed to long periods of excess body heat accrual.

The flap 110 of FIGS. 1B and 2 comprises a base 111. The flap 110 further comprises a pouch into which a cooling agent is insertable. FIGS. 6A to 6D shows several alternative flap configurations.

Figure 6A:
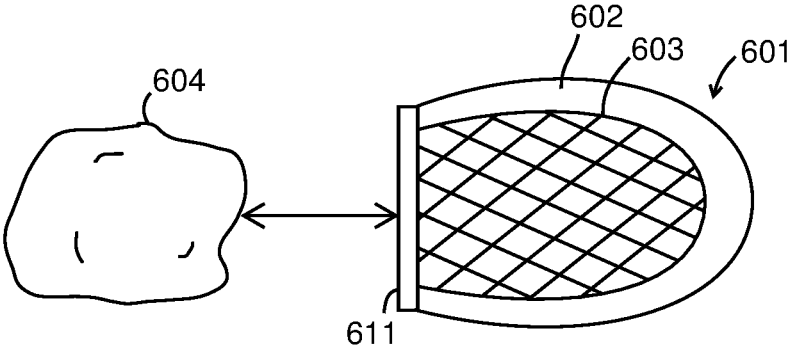
FIGS. 6A, 6B, 6C, and 6D are alternative flap configurations.

FIG. 6A shows a flap 601 which comprises a backing 602 and a material 603. The base 611 is attached to a remainder of a glove as discussed above for base 111. The material 603 may alone form a pouch, or the material 603 and backing 602 may together form a pouch. A cooling agent 604 is insertable into the pouch.

Figure 6B:
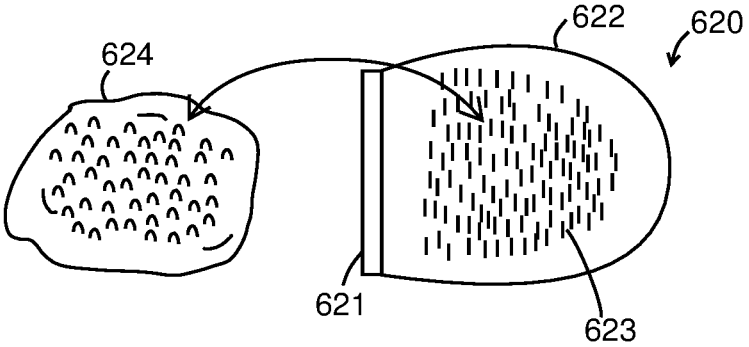

FIG. 6B shows a flap 620 which may consist simply of a backing 622 and a base 621 attached to a remainder of a glove as discussed above. The backing 622 may include a fastener 623 such as one half of a hook-and-loop fastener (e.g., Velcro®). The second half of such a hook-and-loop fastener may be arranged on the cooling agent 624. With such a fastening system, the cooling agent 624 may simply be applied to the backing 622 without any pouch required.

Figure 6C:
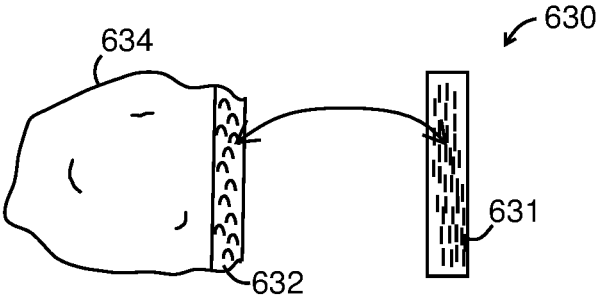

FIG. 6C shows a flap 630 which may consist simply of a base 631 attached to a remainder of a glove. The base 631 may include a fastener such as one half of a hook-and-loop fastener (e.g., Velcro®). The second half of such a hook-and-loop fastener may be provided on an area 632 of the cooling agent 634. With such a fastening system, the cooling agent 634 may simply be applied to the base 631 without requiring a full backing or pouch on the glove itself. This embodiment minimizes the materials required of the glove.

Figure 6D:
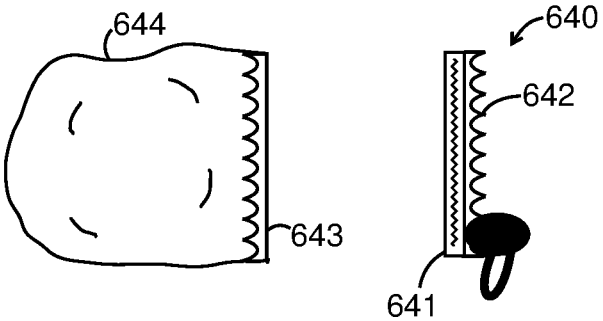

FIG. 6D shows a flap 640 which may comprise a backing 641 to which a zipper or one-half a zipper 642 is fixed. A complementary zipper or one-half zipper 643 may be arranged on the cooling agent 644. With such a fastening system, the cooling agent 644 may simply be attached to the base 641 without requiring a full backing or pouch on the glove itself, minimizing materials required of the glove.

All of the embodiments described above have the advantage of offering considerable flexibility with respect to interchangeability of cooling agents.

Figure 7:
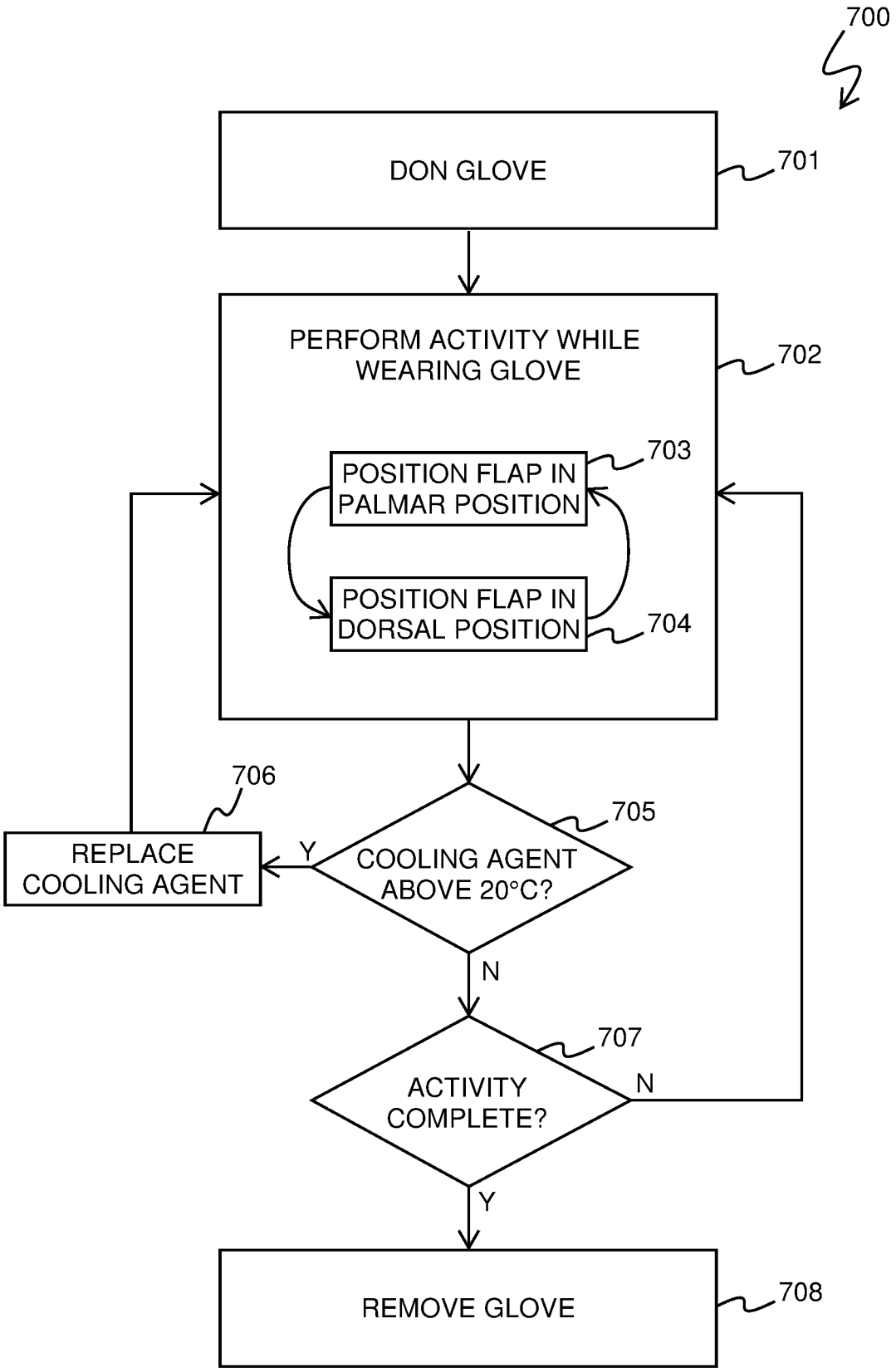
FIG. 7 is a method of using a palm cooling glove.

FIG. 7 is a method 700 of using a palm cooling glove. At step 701 a user dons the glove (or two gloves for maximum heat transfer). Step 701 includes inserting/attaching a pre-chilled cooling agent to the flap. At step 702 the user performs an activity while wearing the glove(s). The gloves have sufficient dexterity as to not require their removal during the activity. While the activity is performed, the user repeatedly alternates the positions of the flap between a palmar position (step 703) and a dorsal position (step 704), e.g., every 5-10 minutes. Depending on the duration of activity at step 702 the cooling agent may require replacement with a fresh pre-chilled cooling agent. At step 705 a user may assess whether the cooling agent has become too warm for desired effectiveness. If the cooling agent is above 20° C., for example, the cooling agent may be replaced with a fresh pre-chilled cooling agent at step 706. Pre-chilled cooling agents need to be less than about 33° C. to be less than a normal skin temperature. Pre-chilled cooling agents are preferably less than 25° C. more preferably less than 20° C., so as to be cooler than ambient temperature. Pre-chilled cooling agents are most effective and last longest at still cooler temperatures, preferably 15° C. or less, 10° C. or less, or 5° C. or less. Exemplary pre-chilled cooling agent starting temperature ranges include 0-5° C., 1-4° C., 1-3° C., and 1-15° C. Palm cooling gloves may be worn for an entire duration of an activity 702 without being removed. Once the activity is completed (step 707), the gloves may be removed at step 708.

While exemplary embodiments of the present invention have been disclosed herein, one skilled in the art will recognize that various changes and modifications may be made without departing from the scope of the invention as defined by the following claims.

What is claimed is:

1. A palm cooling glove, comprising a covering sized and shaped to cover part or all of a human hand, the covering having a palmar side, a dorsal side, a first tube sized for a little finger, and a second tube sized for a thumb;

a fastener;

a flap attached to the covering where the palmar side and dorsal side meet below the first tube, wherein the flap is configured to be moveable between and reversibly fixable at the palmar side with the fastener and the dorsal side of the glove while the glove is worn and without removing the glove from the human hand; and a cooling agent with a thermal conductivity of at least 0.606 W/(m K) and a heat capacity of at least 4.184 Joules, the cooling agent being attachable to the flap, wherein a first thermal conductivity exists between the cooling agent and an interior of the covering when the cooling agent is fixed at the dorsal side, wherein a second thermal conductivity exists between the cooling agent and the interior of the covering when the cooling agent is fixed at the palmar side, wherein the first thermal conductivity is less than the second thermal conductivity.

2. The palm cooling glove of claim 1, further comprising a compartment at the dorsal side of the covering sized to accommodate the flap, configured to insulate the cooling agent, and configured to reversibly fix the flap at the dorsal side.

3. The palm cooling glove of claim 2, wherein the flap is a nylon-based mesh with gaps between strands of the mesh.

4. The palm cooling glove of claim 1, wherein the flap has a thickness no greater than 0.2 cm.

5. The palm cooling glove of claim 1, wherein the flap includes a pouch.

6. A palm cooling glove, comprising a covering sized and shaped to cover part or all of a human hand, the covering having a palmar side, a dorsal side, a first tube sized for a little finger, and a second tube sized for a thumb;

a fastener;

a compartment;

a flap attached at a side of the covering moveable between and reversibly fixable at the palmar side with the fastener and the dorsal side with the compartment while the glove is worn and without removing the glove from the human hand; and a cooling agent attachable to the flap and moveable with the flap between the palmar side and the dorsal side without removing the cooling agent from the flap, wherein a first thermal conductivity exists between the cooling agent and an interior of the covering when the cooling agent is fixed at the dorsal side, wherein a second thermal conductivity exists between the cooling agent and the interior of the covering when the cooling agent is fixed at the palmar side, wherein the first thermal conductivity is less than the second thermal conductivity.

7. The palm cooling glove of claim 6, wherein the flap comprises a pouch, wherein the cooling agent is attachable to the flap by insertion of the cooling agent into the pouch.

8. The palm cooling glove of claim 7, wherein the pouch is a mesh with gaps between strands of the mesh.

9. The palm cooling glove of claim 8, wherein the mesh is nylon-based.

10. The palm cooling glove of claim 6, wherein the compartment is sized to accommodate the flap.

11. The palm cooling glove of claim 10, wherein the compartment is insulated.

12. The palm cooling glove of claim 6, wherein the covering comprises open fingertips.

* * * * *